United States Patent [19]

Fangmeier

[11] 4,037,446

[45] July 26, 1977

[54] METHOD OF PRODUCING BRIGHT STEEL FROM ROLLED STEEL WIRE

[75] Inventor: Ralf Fangmeier, Solingen, Germany

[73] Assignee: Th.Kieserlin & Albrecht, Solingen, Germany

[21] Appl. No.: 698,256

[22] Filed: June 21, 1976

[30] Foreign Application Priority Data

July 19, 1975 Germany ..... 2532366

[51] Int. Cl.[2] ..... B21B 15/00

[52] U.S. Cl. ..... 72/68; 72/70; 72/78

[58] Field of Search ..... 140/139; 72/68, 70, 72/78, 79, 130, 275; 29/33 F

[56] References Cited

U.S. PATENT DOCUMENTS

| | | | |
|---|---|---|---|
| 1,809,880 | 6/1931 | Wise | 72/70 |
| 1,912,940 | 6/1933 | Herr | 72/79 |
| 2,394,381 | 2/1946 | Hoern | 29/33 F |
| 2,922,460 | 1/1960 | Schwendenwein | 140/139 |

*Primary Examiner*—Lowell A. Larson
*Attorney, Agent, or Firm*—Michael J. Striker

[57] ABSTRACT

Method of producing bright steel from rolled steel wire, in which the diameter of the rolled wire is first reduced by passing the same through a calibrating device, preferably a reducing mill, whereby internal stresses assymetrical with respect to the wire axis are produced in the wire, thereafter removing peripheral surface portions from the wire and subsequently straightening the wire, and subjecting the wire before removing peripheral surface portions therefrom to a radial bending force rotating about the axis of the wire to plastically deform the latter to thus reduce the assymetrical internal stresses to thereby improve the perfect roundness of the finished product.

6 Claims, 1 Drawing Figure

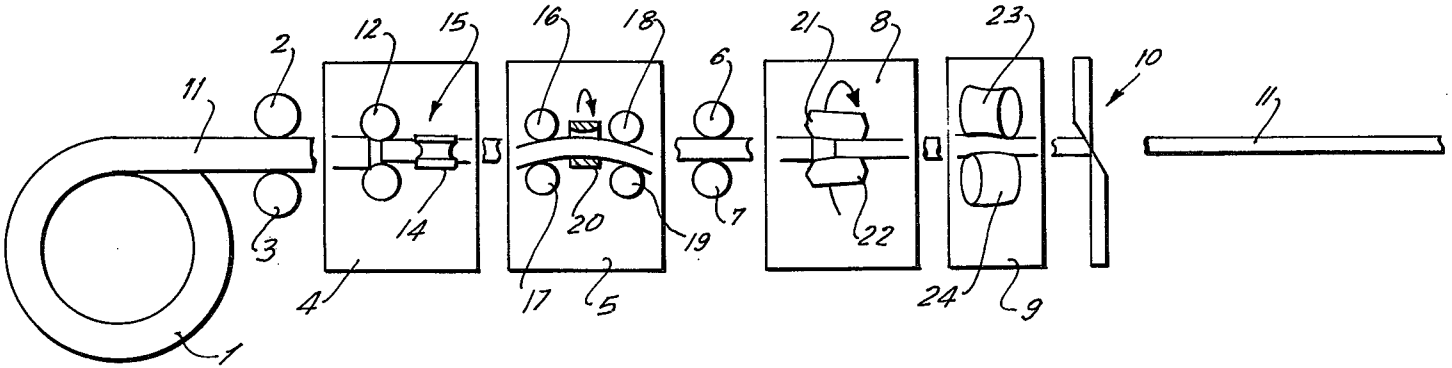
1
2
3
4
5
6
7
8
9
10
11
11
12
14
15
16
17
18
19
20
21
22
23
24

METHOD OF PRODUCING BRIGHT STEEL FROM ROLLED STEEL WIRE

BACKGROUND OF THE INVENTION

The present invention relates to a method for the production of bright steel from rolled steel wire in which the rolled wire is first passed through a straightening and calibrating device to reduce its diameter, then subjected to a peeling operation in which peripheral surface portions of the wire are removed, whereafter the wire is straightened, or whereafter the wire is cut into portions of predetermined length which are then straightened.

In order to essentially increase the output of installations for the production of bright steel from rolled wire, it has been known for quite some time to reduce the diameter of the hot rolled wire prior to the peeling operation in a straightening and calibrating device. This method step has essential advantages. First of all, it is not necessary to pre-treat the wire, since even hot-rolled steel with sharp bends is perfectly straightened in the straightening and calibrating device, properly calibrated and also partly descaled. An additional advantage is that, by calibrating the wire, the material loss during the subsequent peeling operation can be held to a minimum.

If the bright steel wire has to be produced with a high surface finish and to very close tolerances, then the peeled wire is subsequently drawn through a drawing die and subsequently thereto wound up on a reel or cut into portions of desired lengths. If the wire is, subsequent to the peeling operation, drawn through a drawing die, the thus obtained tolerances and the roundness of the bright steel will be sufficient for most applications.

For the production of conical, respectively double conical, helical springs, wire sections are required which have varying diameters over the length thereof. The production of such wire sections of modern peeling machines causes no difficulties since it is possible to control the peeling knives during their rotation about the wire axis in such a manner that the successive sections of the wire will obtain the desired form. A continuous production of such blanks from rolled wire is therefore possible. The individual blanks are separated from each other after the peeling operation and may be subsequently straightened. The straightening of such conical, respectively double conical, wire sections or rods does not present any great difficulties.

Surprisingly, it has however been ascertained that the roundness of the straightened wire sections or rods is inferior to that before the straightening and is not within the close tolerances which are required by the industry. Tests have confirmed the assumption that the change, respectively the impairment of the diameter tolerance, is caused through internal stresses, assymetrical with respect to the wire axis, which are produced in the wire during the reducing process.

SUMMARY OF THE INVENTION

It is an object of the present invention to produce bright steel sections of perfect roundness from rolled steel wire, especially hot rolled steel wire.

It is a special object of the present invention to reduce the above-mentioned detrimental internal stresses created in the wire during the calibrating step.

With these and other objects in view, which will become apparent as the description proceeds, the method according to the present invention of manufacturing bright steel from rolled steel wire mainly comprises the steps of reducing the diameter of the rolled steel wire by passing the same through a calibrating device, removing peripheral surface portions from the steel wire, and thereafter straightening the wire, and imparting to the wire, before the surface removing step, a radial bending force moving in a circle about the wire axis to plastically deform the wire to thus reduce internal stresses assymetrical with respect to the wire axis produced in the wire during the reducing step.

While basically various possibilities exist to reduce the aforementioned detrimental internal stresses, for instance by milling the wire or treat the same by ultrashockwaves, it is an essential feature according to the present invention to remove the aforementioned internal stresses by applying a rotational bending force to the wire to plastically deform the same.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE of the drawing schematically illustrates an arrangement for carrying out the process according to the present invention.

DESCRIPTION OF THE PREFERRED EMBODIMENTS

The drawing schematically illustrates in a single FIGURE an arrangement for carrying out the process according to the present invention. As shown in the drawing a rolled wire 11 is pulled from a reel 1 by a pair of driven rolls 2 and 3 engaging opposite surface portions of the wire and the wire is thereby fed into reducing mill 4, in which the diameter of the wire is reduced by passing the wire through the nip of two pairs of rolls 12, 13, and 14, 15, respectively rotatable about axes normal to each other and to the axis of the wire, in which the nip between the first pair or rolls 12 and 13 is smaller than the diameter of the rolled wire fed by the driven rools 2 and 3 into the reducing mill and in which the nip between the second pair of rolls 14 and 15 is slightly smaller than the nip between the first pair. During this diameter reducing process internal stresses, assymetrical with respect to the wire axis, are produced in the wire and to remove or at least essentially reduce these stresses, the wire, after leaving the reducing mill, is passed between two pairs of rolls 15, 17 and 18, 19 of a bending apparatus 5. Intermediate the two pairs of rolls of the bending apparatus 5 the wire is passed through and engaged by a tubular member 20, which is orbited, as indicated by the arrow, by known means not shown in the drawings, about the straight path defined by the successive pairs of rolls 16, 17 and 18, 19, to be continuously bend far beyond its elastic limit and thus plastically deformed. After leaving the bending apparatus 5, the wire is passed between a pair of driven, intermediate transporting rolls 6 and 7 and fed into a peeling device 8 provided with a cutter head rotating about the wire axis and having at least two knives 21 and 22, adjustable in a known manner toward the wire axis, to remove peripheral surface portions of the wire. Subsequently thereto the wire is passed through a straightening apparatus 9 between a concave roll 23 and a convex roll 24 in which the wire is straightened and finally the wire is passed through a cutting apparatus 10 of known construction and arranged for cutting the wire 11 in portions of desired length.

It is to be understood that the eccentricity of the tubular member 20 of the bending apparatus with respect to the straight path defined by the roller pair 16, 17 and 18, 19 may be adjusted, in a known manner, depending on the diameter and other material characteristics of the wire to be treated, such as hardness and composition of the wire material, to bend the wire, as mentioned before, far beyond its elastic limit to thereby essentially reduce the internal stresses created therein during its passage through the reducing mill. Any remaining internal stresses are further reduced by the following peeling process. In the subsequent straightening process, no undesired cross-section deformation can occur. Due to such reduction of the internal stresses, the straightness of the final product is also improved.

It is mentioned that the straightening process can also be carried out after the wire is cut into individual sections, in a manner well known in the art.

It will be understood that each of the elements described above, or two or more together, may also find a useful application in other types of methods of manufacturing bright steel from rolled steel wire, differing from the types described above.

While the invention has been illustrated and described as embodied in a method of manufacture of bright steel from rolled steel wire, especially hot rolled steel wire, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that from the standpoint of prior art, fairly constitute essential characteristics of the generic or specific aspects of this invention.

What is claimed as new and desired to be protected by Letters Patent is set forth in the appended claims:

1. A method of converting rolled steel wire into straight bright steel wire, comprising, in combination, the steps of transporting steel wire along a predetermined path through a straightening means; removing peripheral surface portions from the steeel wire entering the straightening means by transporting the steel wire through a peeling means located upstream of the straightening means; reducing the diameter of the steel wire entering the peeling and straightening means by transporting the steel wire through a roller calibrating means located upstream of the peeling means, the roller calibrating means being operative for reducing the diameter of the wire and imparting thereto a round cross-sectional shape in a manner incidentally producing within the thusly calibrated wire persisting internal stresses which tend to result in a loss of roundness of the cross-sectional shape of the steel wire occurring as the latter emerges from the straightening means; and preventing such loss of roundness by plastically deforming the steeel wire to a point beyond its elastic limit using an orbital wire bender located upstream of the peeling means and downstream of the calibrating means.

2. A method as defined in claim 1, and including the step of cutting the wire after the straightening step into portions of predetermined length.

3. A method as defined in claim 1, wherein the step of reducing the wire is carried out in a reducing mill having two pairs of opposite rolls, with the axis of one roll pair arranged normal to the axis of the other roll pair.

4. A method as defined in claim 1, wherein the step of removing peripheral surface portions from the wire is carried out in a peeling apparatus having a cutter head rotating about the axis of the wire.

5. A method as defined in claim 1, wherein said step of plastically deforming further comprises the step of guiding the wire between two pairs of rolls spaced in longitudinal direction of the wire from each other and defining a straight path, and deflecting the wire between the pair of rolls out of the straight path by means engaging the wire and orbiting about the straight path.

6. A method as defined in claim 1, wherein the step of straightening the wire comprises the step of engaging the wire at opposite peripheral surface portions by a pair of rolls having axes askew to the wire axis, and wherein one of the rolls has a concavely curved peripheral surface and the other a convexly curved peripheral surface.

* * * * *